US008186252B2

(12) United States Patent
Guaraldi

(10) Patent No.: US 8,186,252 B2
(45) Date of Patent: May 29, 2012

(54) METHOD AND APPARATUS FOR TRIMMING AND TRANSPORTING PRINTED PRODUCTS IN A TRIMMER

(75) Inventor: Glenn Alan Guaraldi, Kingston, NH (US)

(73) Assignee: Goss International Americas, Inc., Durham, NH (US)

( * ) Notice: Subject to any disclaimer, the term of this patent is extended or adjusted under 35 U.S.C. 154(b) by 845 days.

(21) Appl. No.: 12/077,491

(22) Filed: Mar. 18, 2008

(65) Prior Publication Data

US 2009/0238661 A1 Sep. 24, 2009

(51) Int. Cl.
*B26D 1/00* (2006.01)
*B26D 7/06* (2006.01)

(52) U.S. Cl. ..... 83/13; 83/404; 83/422

(58) Field of Classification Search ..... 83/934, 83/904, 404, 422, 410, 435.2, 13
See application file for complete search history.

(56) References Cited

U.S. PATENT DOCUMENTS

| | | | | |
|---|---|---|---|---|
| 3,733,947 | A | 5/1973 | Bryson et al. | |
| 3,811,350 | A | 5/1974 | Marciniak | |
| RE28,840 | E | 6/1976 | Sarring | |
| 4,240,540 | A | 12/1980 | Hobbs et al. | |
| 4,245,766 | A | 1/1981 | Johnson et al. | |
| 4,260,145 | A | 4/1981 | Mebus et al. | |
| 4,328,727 | A | 5/1982 | Tokuno | |
| 5,833,226 | A | 11/1998 | Claassen | |
| 5,997,460 | A | 12/1999 | Young | |
| 6,152,002 | A | 11/2000 | Mueller | |
| 6,431,039 | B1 | 8/2002 | Jacobson et al. | |
| 6,536,319 | B1 * | 3/2003 | Boss | 83/247 |
| 6,766,720 | B1 | 7/2004 | Jacobson et al. | |
| 6,796,209 | B2 | 9/2004 | Boss | |
| 6,895,847 | B2 * | 5/2005 | Muller | 83/618 |
| 6,994,337 | B1 | 2/2006 | Cracknell et al. | |
| 7,021,185 | B2 * | 4/2006 | Cote et al. | 83/268 |
| 7,044,902 | B2 | 5/2006 | d'Agrella et al. | |
| 7,213,493 | B2 * | 5/2007 | Cote et al. | 83/273 |
| 7,384,039 | B2 * | 6/2008 | Cote et al. | 271/243 |
| 7,765,907 | B2 * | 8/2010 | Meyer | 83/99 |
| 2001/0037708 | A1 | 11/2001 | Matthes et al. | |
| 2002/0148339 | A1 * | 10/2002 | Zechini | 83/646 |
| 2003/0079587 | A1 * | 5/2003 | Cote et al. | 83/13 |
| 2004/0112195 | A1 * | 6/2004 | Lorenzi | 83/546 |
| 2005/0201850 | A1 | 9/2005 | Numberger et al. | |
| 2005/0285319 | A1 | 12/2005 | Lee | |
| 2006/0081100 | A1 | 4/2006 | Fassbind | |
| 2007/0089573 | A1 | 4/2007 | Williams et al. | |
| 2007/0144321 | A1 * | 6/2007 | Cote et al. | 83/13 |
| 2007/0209492 | A1 | 9/2007 | Schmid | |

FOREIGN PATENT DOCUMENTS

| | | |
|---|---|---|
| EP | 1 152 310 | 11/2001 |
| WO | WO 91/16181 | 10/1991 |

* cited by examiner

*Primary Examiner* — Boyer D Ashley
*Assistant Examiner* — Omar Flores Sanchez
(74) *Attorney, Agent, or Firm* — Davidson, Davidson & Kappel, LLC

(57) ABSTRACT

A book trimmer is provided. The book trimmer includes an edge trimming knife movable back and forth in a book travel direction and a conveyor downstream of the edge trimming knife. The conveyor includes a reciprocating section movable back and forth in the book travel direction receiving books trimmed by the edge trimming knife. A method for trimming a book is also provided.

18 Claims, 10 Drawing Sheets

METHOD AND APPARATUS FOR TRIMMING AND TRANSPORTING PRINTED PRODUCTS IN A TRIMMER

BACKGROUND OF THE INVENTION

The present invention relates generally to a printed product trimmer and more specifically to a method and apparatus for trimming and transporting printed products in a printed product trimmer.

U.S. Pat. No. 3,733,947, which is incorporated by reference herein, discloses a machine for performing trimming operations upon the front and side edges of a book advancing through the machine. The machine includes a front edge trimming table which is reciprocated in a horizontal direction and receives a book from an infeed conveyor as the table moves in the direction of the conveyor. As the table continues to move in the direction of the infeed conveyor, the book is clamped to the table and the front edge of the book is trimmed.

U.S. Pat. No. 3,811,350 discloses a sheet material trimming method and apparatus. During operation of the trimmer mechanism, a continuous stream of untrimmed sheet material assemblages is transported from a collator or other source to the trimmer mechanism by a known chain type conveyor. Two sets of conveyor belts clampingly grip the sheet material assemblage to retain the orientation as it is trimmed at the first trim station, transported to the second trim station, and trimmed at the second trim station. An intermittent drive mechanism is provided for moving the conveyor belt through feed strokes.

BRIEF SUMMARY OF THE INVENTION

A book trimmer is provided. The book trimmer includes an edge trimming knife movable back and forth in a book travel direction and a conveyor downstream of the edge trimming knife. The conveyor includes a reciprocating section movable back and forth in the book travel direction receiving books trimmed by the edge trimming knife.

A method for trimming a book is also provided. The method includes trimming an edge of a book at a trim location and reciprocating a downstream conveyor to approach the trim location to receive the book and move away from the trim location.

BRIEF DESCRIPTION OF THE DRAWINGS

The present invention is described below by reference to the following drawings, in which.

DETAILED DESCRIPTION

Figure 1:
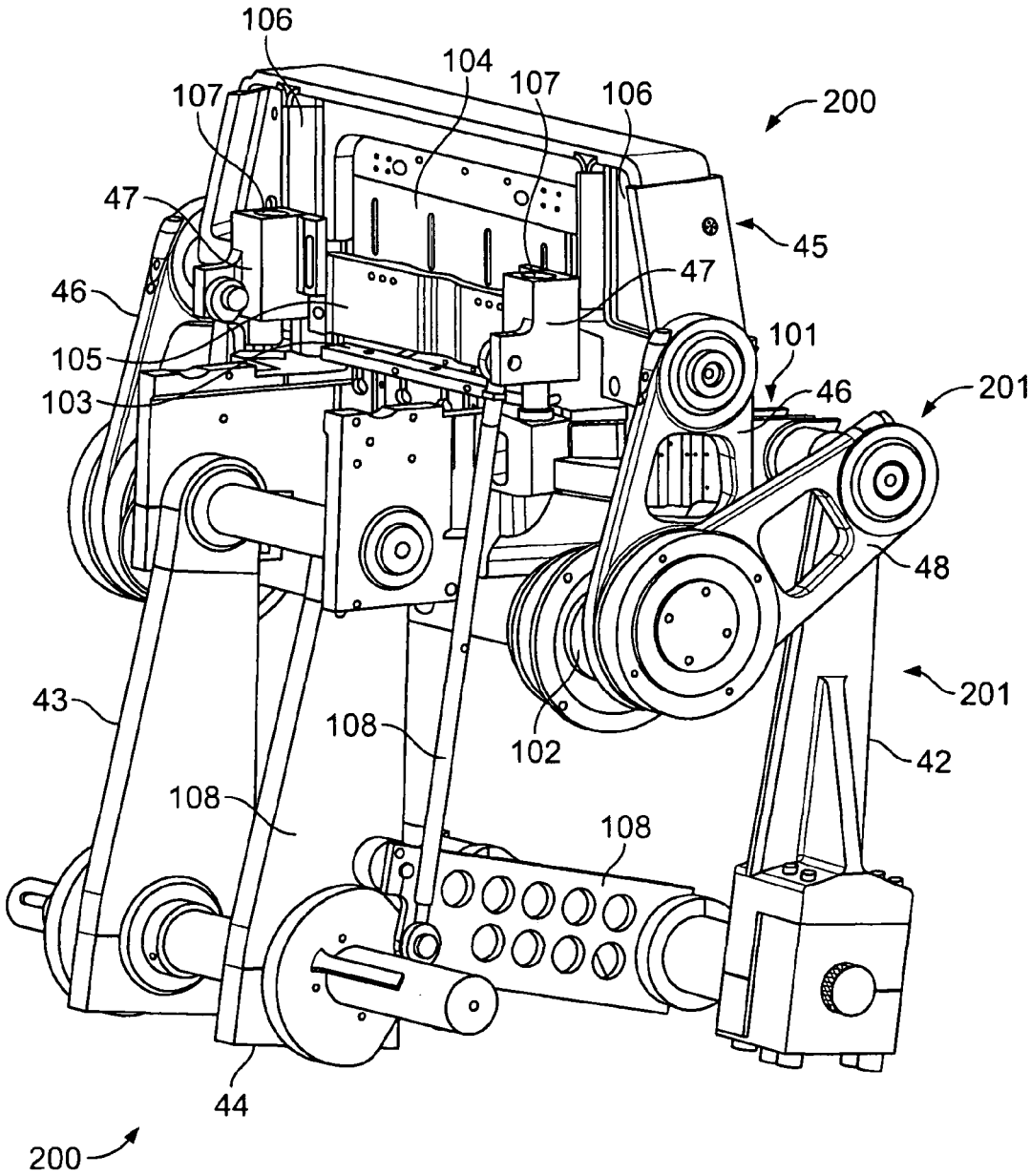
FIG. 1 shows a perspective view of a front knife area in a flying trimmer according to an embodiment of the present invention, with certain elements found in FIG. 10 omitted for clarity in showing an upper front knife and a lower front knife.
Figure 10:
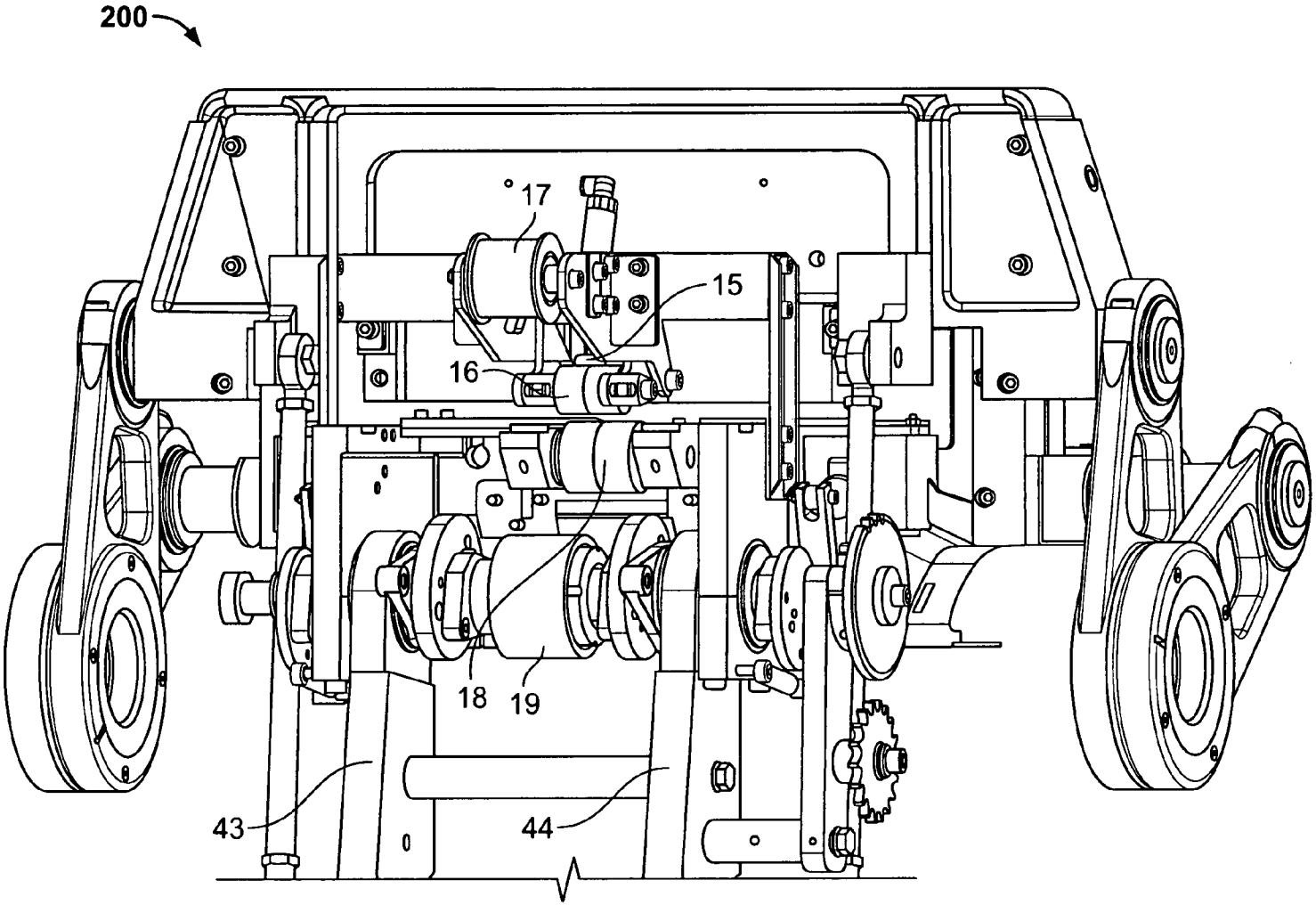
FIG. 10 shows the pulleys shown in FIG. 5 mounted on the front knife carriage shown in FIG. 1.

FIG. 1 shows a perspective view of a front knife area 200 in a flying trimmer according to an embodiment of the present invention, with certain elements found in FIG. 10 omitted for clarity in showing an upper front edge trimming knife 104 and a lower front edge trimming knife 103. Front knife area 200 includes a lower front knife area 201 and an upper knife assembly 45. Lower front knife area 201 includes a front knife carriage 101 and supporting levers 42, 43, 44 (lever 41 being hidden from view and being shown in FIG. 3) that allow front knife carriage 101 to be reciprocated horizontally back and forth by an eccentric crank 102, via links 48. Front knife carriage 101 supports lower front edge trimming knife 103, linear slides 106, and posts 107. Posts 107 can slidably support bearing blocks 47, which move up and down on posts 107. A clamp 105 for printed products is mounted to bearing blocks 47. Upper knife assembly 45 includes upper front edge trimming knife 104 and is mounted on linear slides 106. Clamp 105 and upper knife assembly 45 are respectively arranged so that clamp 105 and upper knife assembly 45 travel with front knife carriage 101 when knife carriage 101 is reciprocated by eccentric crank 102. Upper knife assembly 45 is also reciprocated up and down by eccentric crank 102 to trim books passing through front knife area 200. Clamp 105 can be independently driven up and down by a cam and lever system 108 to engage books while books are trimmed by knives 103, 104.

When a book, or other printed product, is advanced to front knife area 200, clamp 105 can be driven down by cam and lever system 108, by sliding bearing blocks 47 downward, so clamp 105 fixedly engages the book. In a preferred embodiment the downward movement of clamp 105 may be timed with the horizontal movement of carriage 101 so the travel of the book is not disrupted and the book travels fluidly through the flying trimmer. After clamp 105 fixedly engages the book, upper knife assembly 45 can be reciprocated downward toward the book and upper front edge trimming knife 104 can slice through the book and contact lower front edge trimming knife 103, trimming an edge of the book parallel to a spine of the book. Upper knife 104 is then reciprocated upward and clamp 105 is disengaged from the book. While clamp 105 engages the book and knives 103, 104 trim the book, knife carriage 101 can be reciprocated horizontally by eccentric crank 102 so that knives 103, 104 and clamp 105 travel at the same horizontal velocity as the book.

Figure 4:
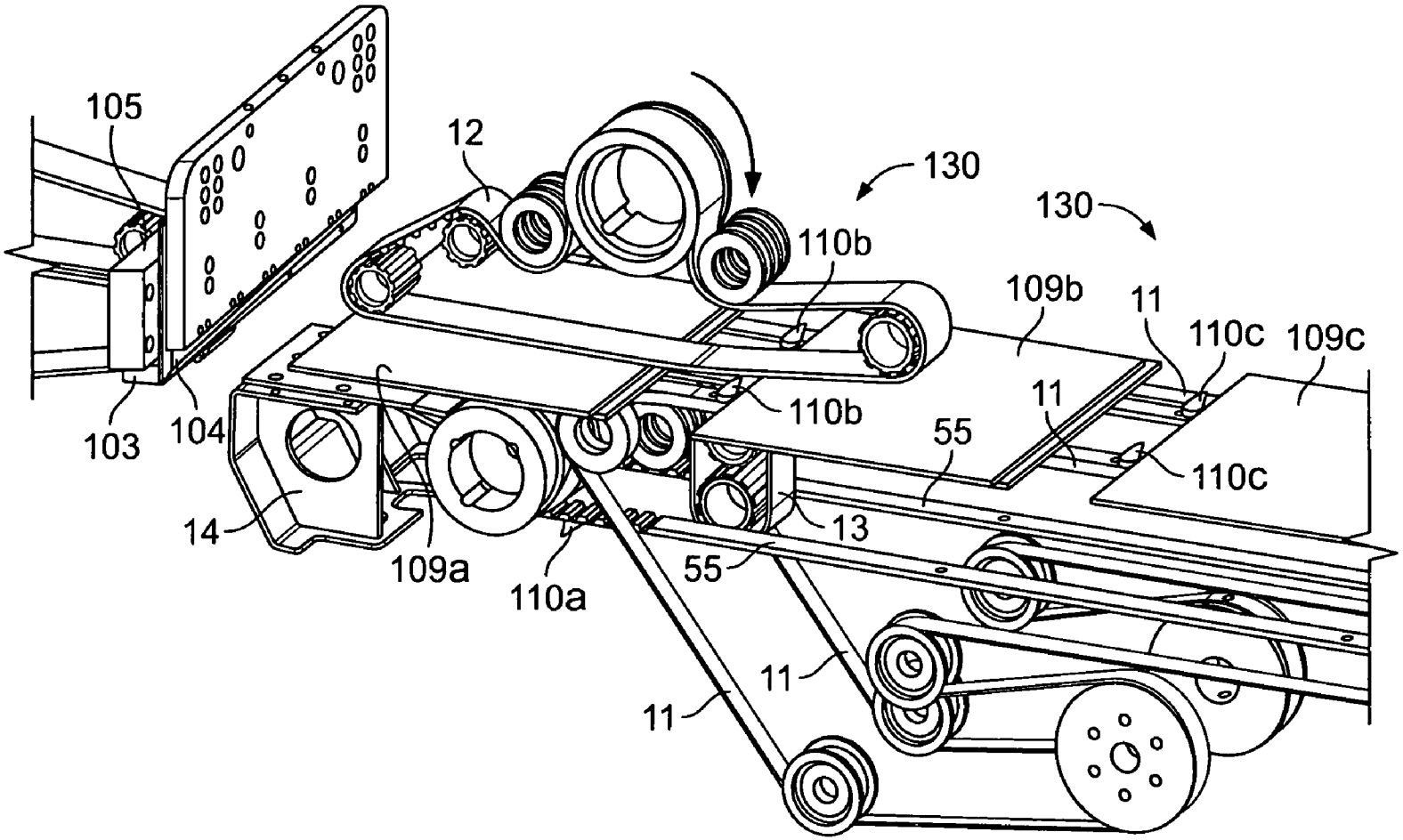
FIG. 4 shows a perspective view of a portion of an infeed device advancing books to the front knife area shown in FIG. 1, which is shown schematically by the lower front knife, the upper front knife, and a clamp.
Figure 5:
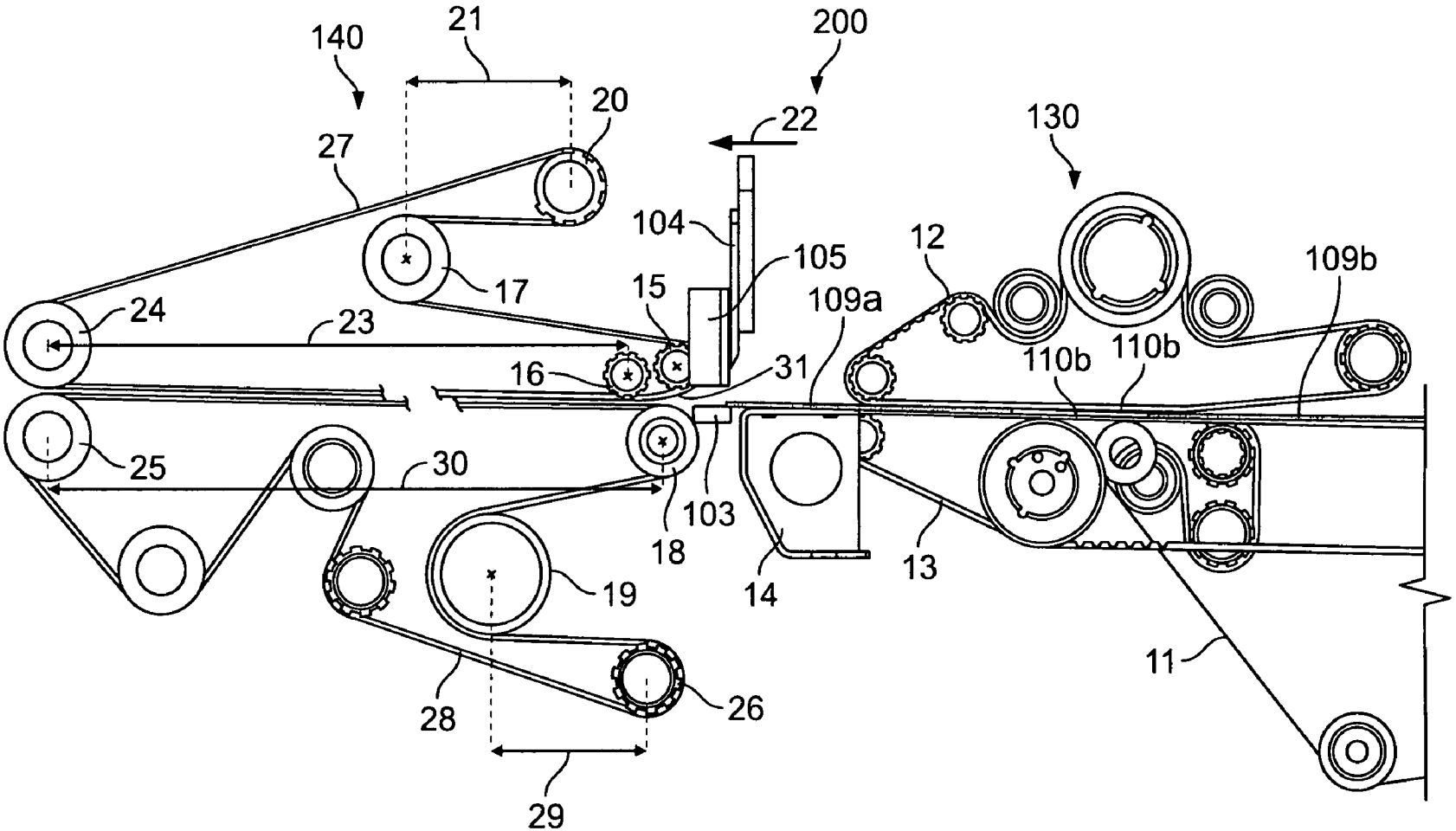
FIG. 5 shows a schematic side view of the infeed device, lower knife, upper knife, and clamp shown in FIG. 4, and a downstream transport conveyor.

During front edge trimming, books are secured and transported by a transport conveyor 140 (FIG. 5). For each revolution of eccentric crank 102, front knife carriage 101 may complete a full revolution, reciprocating back and forth horizontally in relation to the path of the books to be trimmed, while upper knife 104 oscillates down, contacts lower knife 103, and trims a book during each revolution. Transport of books before and after books are trimmed, for example, is discussed in detail below in relation to FIGS. 4 to 9.

Figure 2:
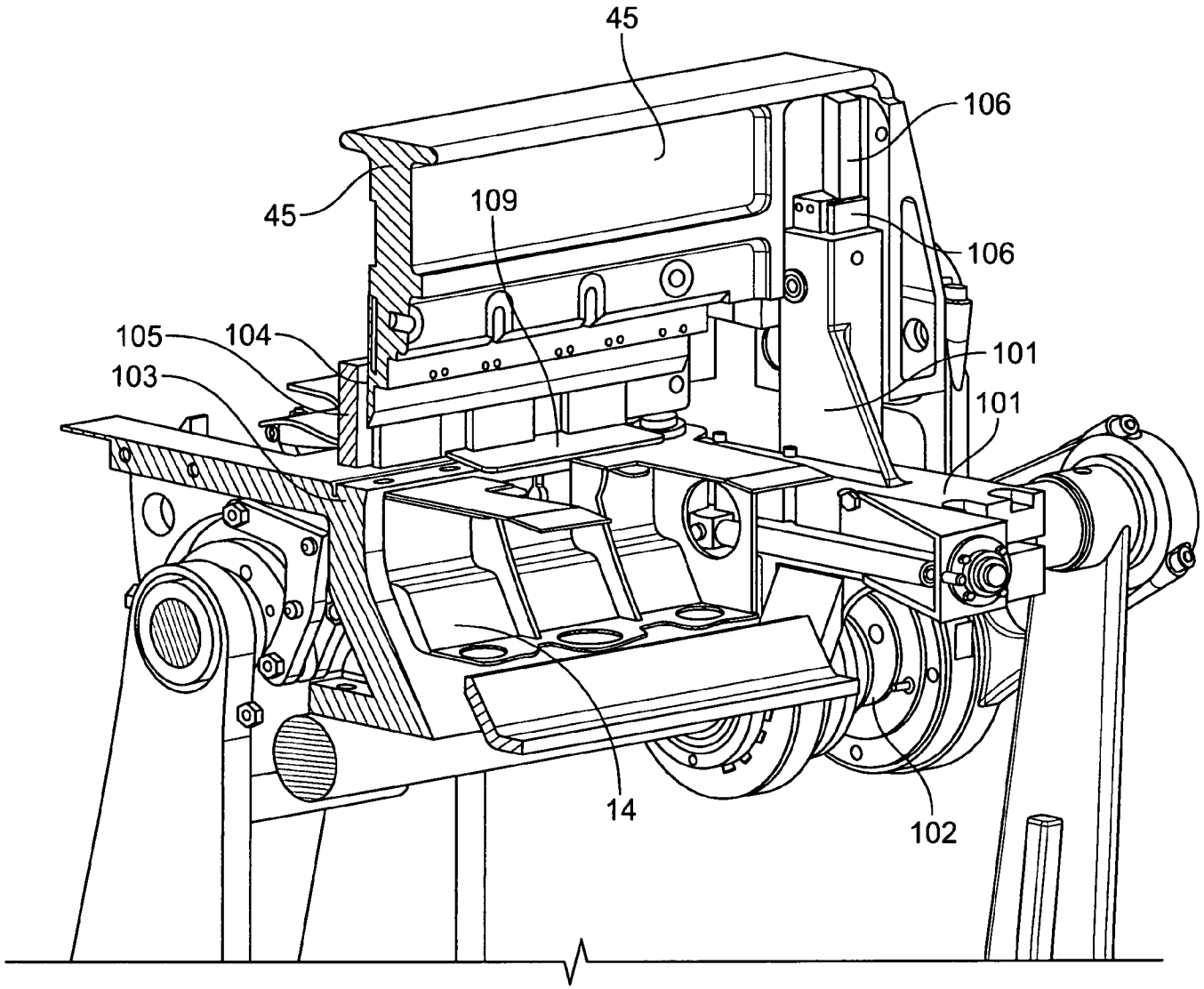
FIG. 2 shows a cross sectional perspective view of the front knife area shown in FIG. 1 and a chip gate.

FIG. 2 shows a cross sectional perspective view of front knife area 200 shown in FIG. 1 and a chip gate 14. A book 109 is present in front knife area 200. Book 109 is supported and transported by transport conveyor 140 (FIG. 5). When book 109 is positioned so that a front edge trim location of book 109 is directly below upper knife 104, and carriage 101 is traveling at a same horizontal velocity as book 109, clamp 105 engages book 109 and upper knife 104 is reciprocated downward so that upper knife 104 quickly contacts lower knife 103, thereby trimming a front edge of book 109. Eccentric crank 102 may slide upper knife assembly 45 via linear slides 106 to reciprocate upper knife 104 downward. In a preferred embodiment, engaging book 109 with clamp 105 and trimming book 109 with knives 103, 104 is a precise process to ensure that book 109 is trimmed at a proper position with minimal chipout and to ensure efficient operation of the flying trimmer. Chip gate 14 may be provided to assure that book 109 is transported to front knife area 200 in a proper orientation, with respect to knives 103, 104 and clamp 105.

Figure 3:
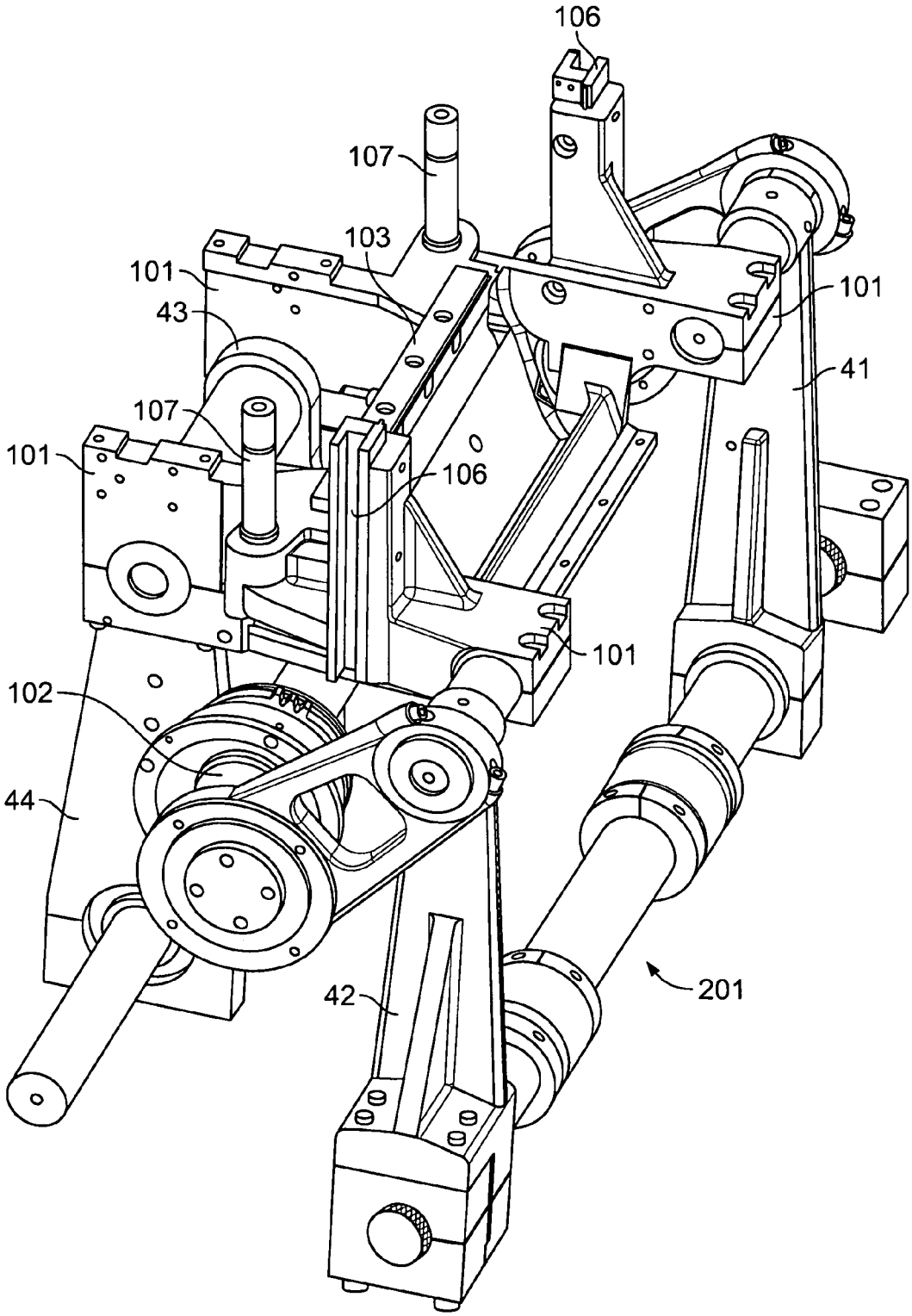
FIG. 3 shows a perspective view of a lower knife area shown in FIG. 1.

FIG. 3 shows a perspective view of lower knife area 201 shown in FIG. 1. In FIG. 3, the view of posts 107 is unobstructed by bearing blocks 47 (FIG. 1). Posts 107 protrude away from carriage 101 a sufficient amount to allow bearing blocks 47 (FIG. 1) to securely slide up and down on posts 107, thereby engaging and disengaging clamp 105 from books that pass through front knife area 200. Linear slides 106 may adjustably mount upper knife assembly 45 (FIG. 1) to carriage 101 and protrude from carriage 101 in a manner allowing upper knife assembly 45 (FIG. 1) to reciprocate downwards and trim books by contacting knife 103 with knife 104 (FIG. 1), then reciprocate upward a sufficient distance to allow books to pass between knives 103, 104 (FIG. 1).

FIG. 4 shows a perspective view of a portion of an infeed device 130 advancing books 109*a*, 109*b*, 109*c* to the embodiment of front knife area 200 shown in FIG. 1, which is shown schematically by lower knife 103, upper knife 104, and clamp 105. Spines of books 109*b*, 109*c* are driven against respective register lugs 110*b*, 110*c* by continuous infeed belts 11. Infeed belts 11 may have a higher velocity than register lugs 110*a*, 10*b*, 110*c*, thus register lugs 110*a*, 110*b*, 110*c*, when contacting books 109*a*, 109*b*, 109*c*, maintain positioning of the spines of books 109*a*, 109*b*, 109*c*, respectively. Register lugs 110*a*, 110*b*, 110*c* may be fixedly attached to continuous register belts 55, which may travel parallel to infeed belts 11 as lugs 110*a*, 110*b*, 110*c* contact books 109*a*, 109*b*, 109*c*. Register lugs 110*b*, 110*c* are spine registering books 109*b*, 109*c* so books 109*b*, 109*c* are in proper alignment to be trimmed by knives 103, 104 of front knife area 200. Lug 110*a* spine registered book 109*a*, then descended out of contact with book 109*a* as book 109*a* was engaged by forwarding belts 12, 13.

Forwarding belts 12, 13 maintain a proper orientation of book 109*a* as book 109*a* enters front knife area 200 for trimming. Forwarding belts 12, 13 may be positioned close to knives 103, 104 to ensure proper orientation of books 109*a*, 109*b*, 109*c* being passed from infeed device 130 to a front edge trim position in front knife area 200. Chip gate 14 may be supporting a portion of book 109*a* not engaged by forwarding belts 12, 13 to ensure proper orientation of book 109*a* so book 109*a* is effectively front trimmed and advanced through the flying trimmer. Chip gate 14, when provided, may reciprocate back and forth in a manner corresponding to the travel of books 109*a*, 109*b*, 109*c*.

FIG. 5 shows a schematic side view of infeed device 130, lower knife 103, upper knife 104, and clamp 105 shown in FIG. 4, and a downstream transport conveyor 140. Transport conveyor 140 will receive books 109*a*, 109*b* from infeed device 130 and maintain proper orientation of books 109*a*, 109*b* during front edge trimming by knives 103, 104. Book 109*a* is beginning to be passed by forwarding belts 12, 13 over knife 103 and under knife 104 into a nip 31 formed by an upper transport belt 27 and a lower transport belt 28 of transport conveyor 140. Chip gate 14 may briefly move in a direction 22 that book 109*a* is traveling as book 109*a* is advanced from infeed device 130 to transport conveyor 140, helping maintain orientation of book 109*a* as book 109*a* spans a space between infeed device 130 and transport conveyor 140.

Belt 27 interacts with pulleys 15, 16, 17, 20, 24 and belt 28 interacts with pulleys 18, 19, 25, 26. Pulleys 20, 24, 25, 26 may be fixed to ground. Pulleys 15, 16, 17, 18, 19, which are each marked with an "x" in FIG. 5, may be mounted on reciprocating front knife carriage 101 (FIG. 1). Pulleys 15, 16, 17, 18, 19 may be reciprocated back and forth in relation to a travel direction 22 of book 109*a* with front knife carriage 101 as front knife carriage 101 (FIG. 1) is reciprocated back and forth in relation travel direction 22 of book 109*a*. Thus, a section of transport conveyor 140 is reciprocated horizontally along with knives 103, 104 and clamp 105. Pulleys 20, 24, 25, 26 do not reciprocate horizontally with knife carriage 101.

As carriage 101 (FIG. 1) travels in direction 22, away from infeed device 130, a belt span 29 between pulleys 19, 26 may lengthen a certain amount while belt span 30 between pulleys 18, 25 may shorten the same amount. Also, as carriage 101 (FIG. 1) travels in direction 22, away from infeed device 130, a belt span 21 between pulleys 17, 20 may lengthen a certain amount while a belt span 23 between pulleys 16, 24 may shorten the same amount. Carriage 101, along with pulleys 15, 16, 17, 18, 19, reciprocates in direction 22 while knives 103, 104 trim book 109*a*.

As carriage 101 (FIG. 1) travels in a direction opposite direction 22, toward infeed device 130, belt span 29 between pulleys 19, 26 may shorten a certain amount while belt span 30 between pulleys 18, 25 may lengthen the same amount. Also, as carriage 101 (FIG. 1) travels in a direction opposite direction 22, toward infeed device 130, belt span 21 between pulleys 17, 20 may shorten a certain amount while belt span 23 between pulleys 16, 24 may lengthen the same amount. Equal belt span adjustment of belt spans 21, 23 and of belt spans 29, 30 provides the advantage that belts 27, 28 need not be stretched as pulleys 15, 16, 17, 18, 19 move back and forth horizontally.

In an alternative embodiment a roll may replace each upper belt 12, 27. The rolls may be positioned, in relation to respective lower belts 13, 28, so that each roll acts with respect to respective lower belt 13, 27 to maintain the position of books passing between infeed device 103 and transport conveyor 140. The rolls may also be raised and lowered to come into contact and come out of contact with passing books. Each belt 13, 28 may also be substituted with a brush or any other mechanism that will marry books to respective lower belts 12, 27 to maintain the orientation of the books as books are transported by belts 12, 27.

Figure 6:
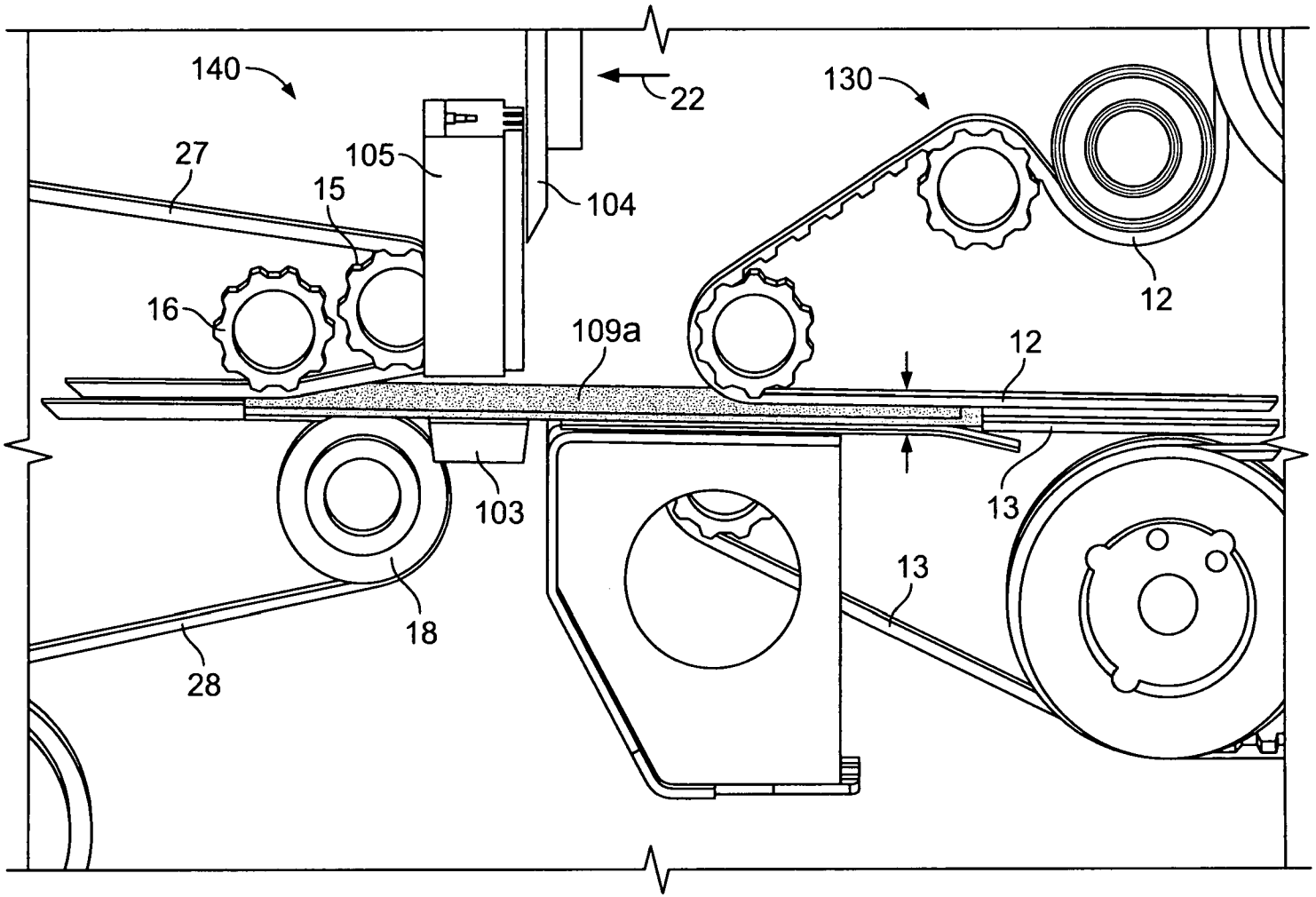
FIG. 6 shows a schematic side view of the embodiment shown in FIG. 5 with a book passing from the infeed device to the transport conveyor.

FIG. 6 shows a schematic side view of the embodiment shown in FIG. 5 with a book passing from infeed device 130 to transport conveyor 140. Book 109*a* is under the control of both forwarding belts 12, 13 and transport belts 27, 28. In a preferred embodiment, book 109*a* is positively transferred from forwarding belts 12, 13 to transport belts 27, 28 with belts 12, 13, 27, 28 traveling at substantially a same velocity. Clamp 105 may be moving downward to clamp book 109*a* when book 109*a* is in proper position to be front edge trimmed by knives 103, 104. Carriage 101 (FIG. 1), along with pulleys 15, 16, 18, knives 103, 104 and clamp 105, is being reciprocated horizontally in a direction opposite direction 22, toward infeed device 130.

Figure 7:
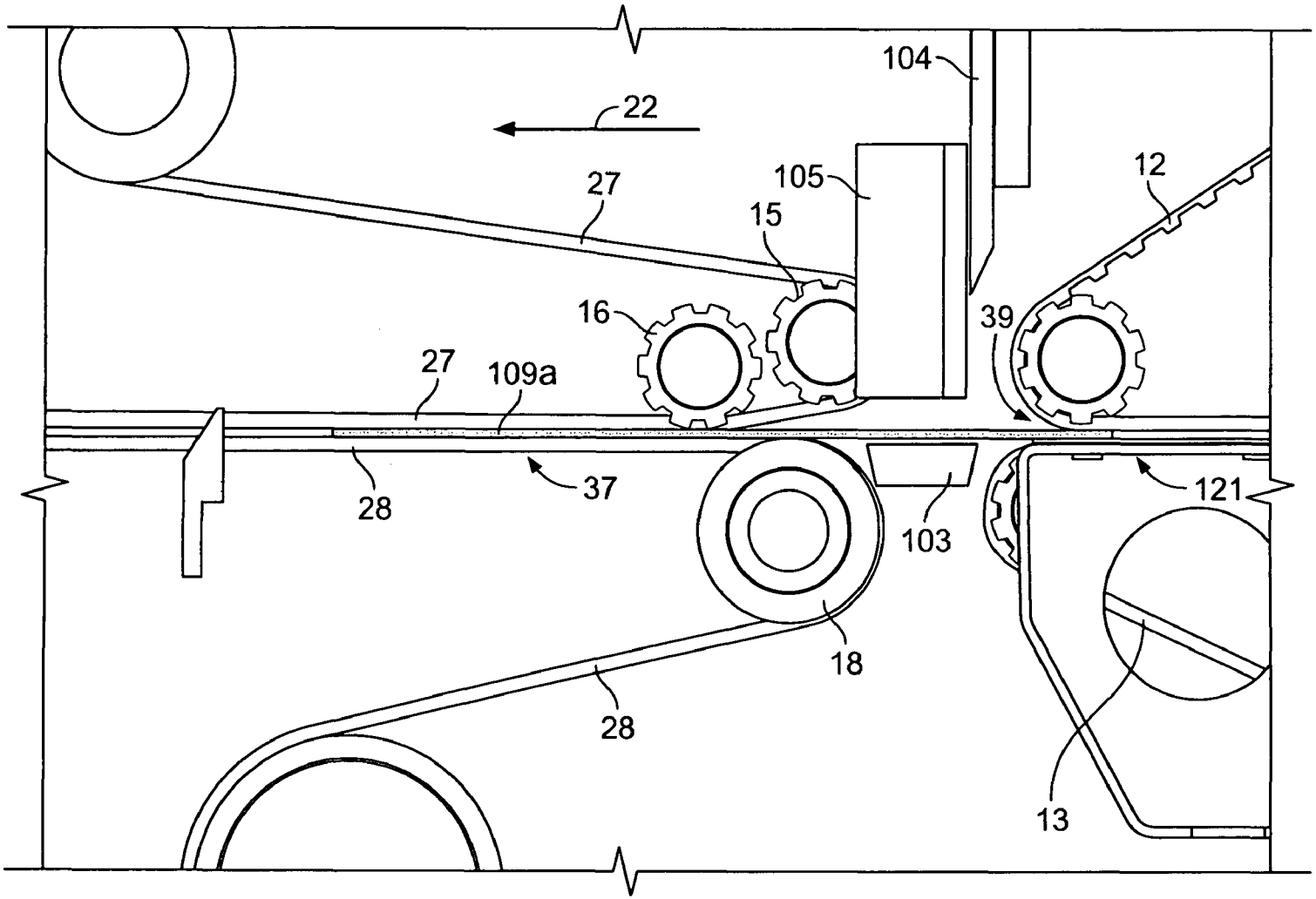
FIG. 7 shows a schematic side view of the embodiment shown in FIG. 5 with a book being released by the infeed device as the book is transported by the transport conveyor.

FIG. 7 shows a schematic side view of the embodiment shown in FIG. 5 with book 109*a* being released by infeed device 130 as book 109*a* is transported by transport conveyor 140. Book 109*a* is passing through a space under clamp 105 and knife 104 and above knife 103. After book 109*a* is released by forwarding belts 12, 13 book 109*a* may be exclusively under control of transport belts 27, 28. A point at which belts 12, 13 last control book 109*a* is determined by a position of a trailing end 121 of book 109*a* and a position of a nip 39 formed by forwarding belts 12, 13. After forwarding belts 12, 13 release control of book 109*a*, transport belts 27, 28 and forwarding belts 12, 13 may run at different velocities. A velocity of transport conveyor 140 may be dynamically adjusted so that when clamp 105 engages book 109*a*, book 109*a* may be traveling at substantially the same velocity as carriage 101 and clamp 105. Carriage 101, along with pulleys 15, 16, 18, knives 103, and clamp 105, is being reciprocated in a direction opposite direction 22, toward infeed device 130.

Figure 8:
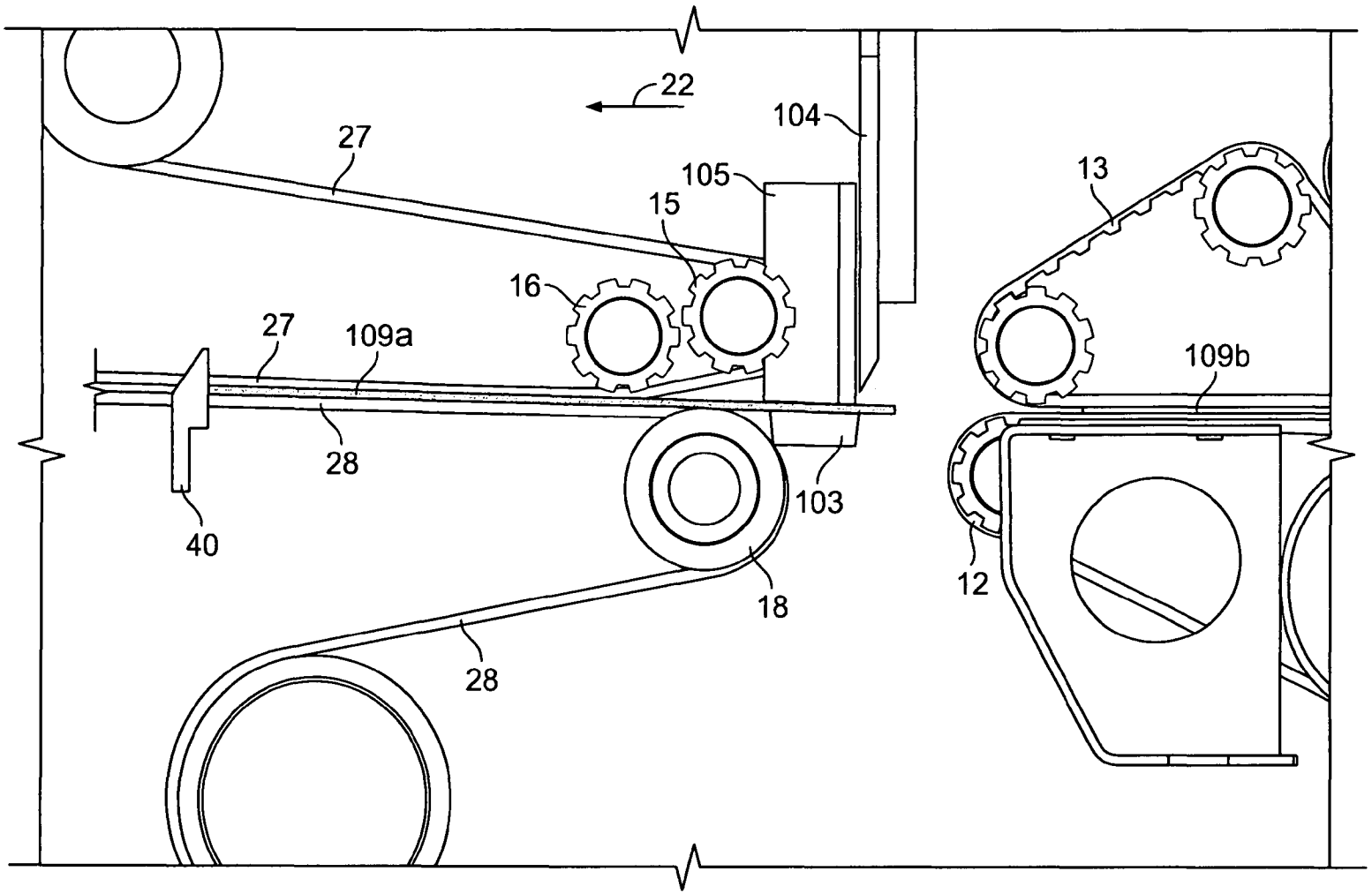
FIG. 8 shows a schematic side view of the embodiment shown in FIG. 5 with the clamp applying pressure to a book as the transport conveyor transports the book.

FIG. 8 shows a schematic side view of the embodiment shown in FIG. 5 with clamp 105 applying pressure to book 109*a* as transport conveyor 140 transports book 109*a*. Upper knife 104 is being oscillated downward to trim a front edge of book 109*a* at a predetermined proper location. Upper knife 104 will trim book 109*a* and contact lower 103 as clamp 105 (FIG. 1) securely engages book 109*a*. Eccentric crank 102 (FIG. 1) is reciprocating carriage 101 (FIG. 1), along with pulleys 15, 16, 18, knives 103, 104 and clamp 105, in direction 22, away from infeed device 130, as clamp 105 applies pressure to book 109*a*. Carriage 101 (FIG. 1) may be traveling at substantially the same horizontal velocity as belts 27, 28, as well as book 109*a*, as clamp 105 is contacting book 109*a* and while knives 103, 104 trim book 109*a*. Clamp 105 applies pressure to book 109*a* without disrupting the position or velocity of book 109*a*, thus helping to eliminate chipout during trimming and increasing the efficiency of the flying trimmer.

Backstops 40 may also be provided to improve the accuracy of the front edge trimming of book 109*a* by knives 103, 104. When backstops 40 are not employed, belts 27, 28 provide sufficient pressure to prevent book 109*a* from slipping as book 109*a* is engaged by clamp 105 and trimmed by knives 103, 104. When backstops 40 are employed, belts 27, 28 can provide less pressure on book 109*a* so that book 109*a* can slide in belts 27, 28 as book 109*a* hits and is aligned by backstop 40. Backstop 40 may also be utilized to skew the trimming by knives 103, 104, if necessary to compensate for errors in cover printing and folding.

Belts 12, 13 may be advancing book 109*b* to belts 27, 28 so that book 109*b* can subsequently been front edge trimmed by knives 103, 104.

Figure 9:
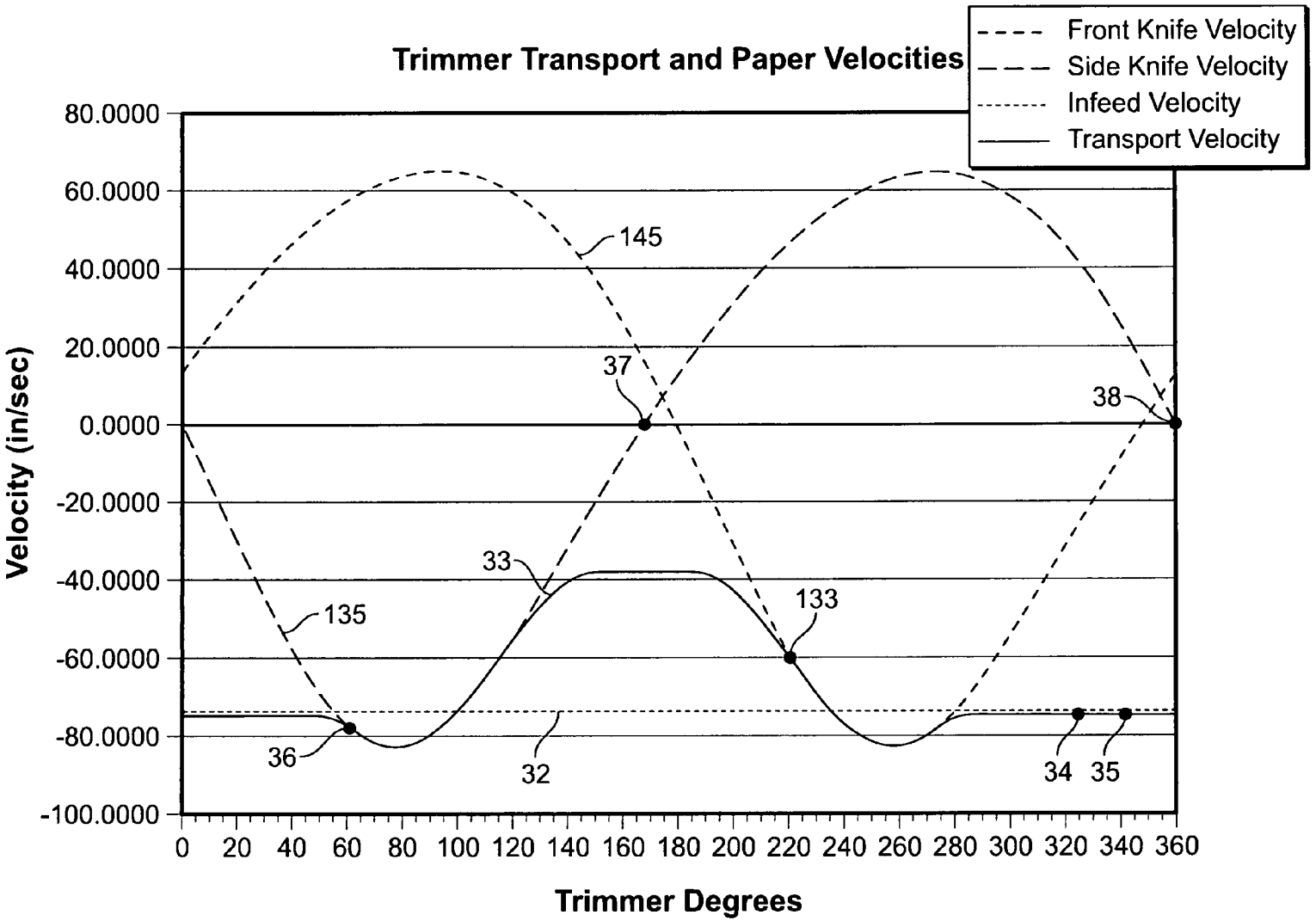
FIG. 9 shows a graph of horizontal velocities of a front knife carriage, a side knife carriage, forwarding belts and transport belts for a complete revolution of the front knife carriage, via an eccentric crank, according to the embodiment of the present invention shown in FIGS. 5 to 8.

FIG. 9 shows a graph of horizontal velocities of front knife carriage 101, a side knife carriage forwarding belts 12, 13 and transport belts 27, 28 for a complete revolution of front knife carriage 101 (FIG. 1), via eccentric crank 102 (FIG. 1), according to the embodiment the present invention shown in FIGS. 5 to 8. Velocity of belts 12, 13 is shown by a line 32, velocity of belts 27, 28 is shown by a curved line 33, velocity of front knife carriage 101 is shown by a line 135 and velocity of the side knife carriage is shown by a line 145. For a given machine velocity, belts 12, 13 run at a constant velocity and belts 27, 28 run at varying velocities during a revolution of front knife carriage 101. Because front knife carriage 101 travels in two horizontal directions during a complete revolution, the velocity of front knife carriage 101 (FIG. 1) reaches both positive and negative values during a revolution of front knife carriage 101. The side knife carriage reciprocates similar to front knife carriage 101, reaching both positive and negative values during a revolution. In this embodiment, during each revolution of front knife carriage 101, front knives 103, 104 trim a single book. A direction of travel 22 of book 109*a*, as shown in FIGS. 5 to 8, is defined as a direction of negative velocity for illustrative purposes related to FIG. 9. Therefore, belts 12, 13, 27, 28 travel only at negative velocities in FIGS. 5 to 8.

A point 37 indicates where carriage 101 (FIG. 1) switches from traveling in direction 22 (FIG. 5 to 9), the direction of travel of book 109*a*, to traveling in a direction opposite of direction 22, toward infeed device 130 (FIG. 5). A point 38 indicates where carriage 101 (FIG. 1) switches from traveling in a direction opposite direction 22, to traveling in direction 22.

Points 34, 35, 36, shown in FIG. 9, indicate the speed of belts 27, 28 at positions of book 109*a* shown in FIGS. 6, 7 and 8, respectively. At point 34, book 109*a* is engaged by both belts 12, 13 and belts 27, 28 and belts 12, 13, 27, 28 are traveling at substantially the same velocity. At this time, front knife carriage 101 (FIG. 1), along with pulleys 15, 16, 17, 18, 19 (FIG. 5), is traveling toward infeed device 130 (FIG. 5), and therefore has a positive velocity, but is decelerating to switch directions at point 38 and reciprocate away from infeed device 130.

At point 35, book 109*a* is no longer engaged by belts 12, 13, but is still engaged by belts 27, 28. After book 109*a* is no longer engaged by belts 12, 13 and belts 27, 28, belts 12, 13, 27, 28 may be traveling at substantially the same velocity, as shown by point 35, or belts 12, 13 and belts 27, 28 may be traveling at different velocities.

At point 36, book 109*a* becomes engaged by clamp 105 and knife 104 oscillates downward to contact knife 103 and trim book 109*a*. Clamp 105 engages book 109*a*, and until knives 103, 104 finish trimming book 109*a*, belts 27, 28 and front knife carriage 101 (FIG. 1), along with clamp 105, knives 103, 104 and pulleys 15, 16, 17, 18, 19, (FIG. 5) travel at substantially the same velocity. At this time, carriage 101 (FIG. 1) and a section of transport device 140 (FIG. 5) are now traveling in direction 22 and thereby have a negative velocity.

After clamp 105 releases book 109*a*, belts 27, 28 can travel at a velocity that varies from front knife carriage 101. Book 109*a* can then be advanced by belts 27, 28 to be side trimmed by side knives of the side knife carriage, which may include components similar to components of front knife carriage 101 (FIG. 1) and may operate in a manner similar to front knife carriage 101. Book 109*a* is engaged by belts 27, 28 during this side trimming. As a clamp of side knife carriage engages book 109*a*, which is indicated by a point 133, and until side knives trim the book, side knife carriage and belts 27, 28 travel at substantially the same velocity. After the clamp of side knife carriage releases the book, belts 27, 28 can travel at a velocity that varies from a velocity of side knife carriage.

In an alternative embodiment front knife carriage 101 is substantially synchronized with side knife carriage, so that as one book is being side trimmed by side knives a following book may be front trimmed by front knives 103, 104, with the horizontal velocities of front knife carriage 101 and the side knife carriage substantially equaling the velocity of belts 27, 28.

FIG. 10 shows pulleys 15, 16, 17, 18, 19 shown in FIG. 5 mounted on front knife carriage 101 shown in FIG. 1. Pulleys 15, 16, 17, 18, 19 are mounted on front knife carriage 101 (FIG. 1), in front knife area 200, near levers 43, 44.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for trimming a book comprising:

trimming an edge of a book at a trim location; and reciprocating a downstream conveyor to approach the trim location to receive the book and move away from the trim location;

wherein the conveyor includes a plurality of movable pulleys that are reciprocated during the reciprocating step and a plurality of stationary pulleys that are not reciprocated during the reciprocating step.

2. The method recited in claim 1 wherein the trimming step includes trimming the front edge of the book with a front knife and the reciprocating step includes reciprocating a carriage that is coupled to both the front knife and the conveyor.

3. The method recited in claim 1 wherein the trimming step includes trimming the front edge of the book with a front knife.

4. The method recited in claim 1 wherein the conveyor includes an upper conveying belt interacting with some of the movable pulleys and some of the stationary pulleys and a lower conveying belt interacting with others of the movable pulleys and others of the stationary pulleys, the upper and lowering conveying belts contacting the book to receive the book.

5. The method recited in claim 1 further comprising delivering the book to the trim location with an upper input belt and a lower input belt, the conveyor receiving a leading edge of the book before a trailing edge of the book is released by the upper input belt and the lower input belt, the trailing edge of the book being the edge trimmed at the trim location.

6. A book trimmer comprising:

an edge trimming knife movable back and forth in a book travel direction; and a conveyor downstream of the edge trimming knife, the conveyor including a reciprocating section movable back and forth in the book travel direction to receive books trimmed by the edge trimming knife;

wherein the conveyor includes a belt having a first belt span of a variable first length defined by a first pulley and a second pulley and a second belt span of a variable second length defined by a third pulley and a fourth pulley, the belt traveling over the first pulley, the second pulley, the third pulley and the fourth pulley, wherein the variable first length and the variable second length vary as reciprocating section moves back and forth in the book travel direction.

7. A book trimmer comprising:

an edge trimming knife movable back and forth in a book travel direction; and a conveyor downstream of the edge trimming knife, the conveyor including a reciprocating section movable back and forth in the book travel direction to receive books trimmed by the edge trimming knife, wherein the conveyor is comprised of:

a plurality of first pulleys;

a first belt of a first constant length traveling over the plurality of first pulleys;

a plurality of second pulleys; and a second belt of a second constant length traveling over the plurality of second pulleys;

wherein the reciprocating section of the conveyor includes at least two first pulleys and at least two second pulleys, the at least two first pulleys movable to maintain the first constant length of the first belt and the at least two second pulleys movable to maintain the second constant length of the second belt as the reciprocating section moves back and forth in the book travel direction.

8. The book trimmer recited in claim 6 further comprising an upper input belt and a lower input belt upstream of the edge trimming knife, the conveyor receiving a leading edge of the book before the trailing edge of the book is released by the upper input belt and the lower input belt, the edge trimming knife trimming the trailing edge of the book after the trailing edge of the book is released by the upper input belt and the lower input belt.

9. The book trimmer recited in claim 6 wherein the reciprocating section moves back and forth in the book travel direction with the edge trimming knife.

10. The book trimmer recited in claim 6 further comprising a knife carriage, the edge trimming knife being supporting by the knife carriage, the reciprocating section being mounted on the knife carriage.

11. The book trimmer recited in claim 10 wherein the knife carriage reciprocates back and forth in the book travel direction and the reciprocating section reciprocates back and forth in the book travel direction with the knife carriage.

12. The book trimmer recited in claim 6 wherein the reciprocating section includes the first pulley.

13. The book trimmer recited in claim 12 wherein the first pulley moves back and forth with the edge trimming knife.

14. The book trimmer recited in claim 12 wherein the conveyor further includes a second belt, a fifth pulley and a sixth pulley, the second belt traveling over the fifth pulley and the sixth pulley and the reciprocating section including the fifth pulley.

15. The book trimmer recited in claim 12 wherein the reciprocating section includes the third pulley.

16. The book trimmer recited in claim 6 wherein as the reciprocating section moves back and forth in the book travel direction the first length increases as the second length decreases and the first length decreases as the second length increases.

17. The book trimmer recited in claim 16 wherein the first length increases by an amount equal to an amount the second length decreases and the first length decreases by an amount the second length increases.

18. The book trimmer recited in claim 6 wherein a belt length of the belt remains constant as reciprocating section moves back and forth in the book travel direction.

* * * * *